US006120398A

United States Patent [19]

Myers

[11] Patent Number: 6,120,398

[45] Date of Patent: Sep. 19, 2000

[54] TOY FOOTBALL WITH SPIRAL LIKE TAIL

[76] Inventor: Jeff D. Myers, 7525 N. Shadow Mountain Rd., Paradise Valley, Ariz. 85253

[21] Appl. No.: 09/207,386

[22] Filed: Dec. 8, 1998

[51] Int. Cl.[7] ..... A63B 43/00

[52] U.S. Cl. ..... 473/613

[58] Field of Search ..... 473/613, 575, 473/576, 586, 594, 603, 604; 273/DIG. 20; D21/712

[56] References Cited

U.S. PATENT DOCUMENTS

| | | | |
|---|---|---|---|
| D. 321,543 | 11/1991 | Gauthier et al. | D21/712 |
| D. 346,001 | 4/1994 | Stillinger et al. | D21/712 |
| 1,629,364 | 5/1927 | Scholly | 473/594 |
| 2,524,546 | 10/1950 | Sinclaire | 273/DIG. 20 |
| 3,225,488 | 12/1965 | Goldfarb | 473/613 |
| 3,428,321 | 2/1969 | Manning | 473/586 |
| 5,261,661 | 11/1993 | Lemmon | 273/DIG. 20 |
| 5,269,514 | 12/1993 | Adler et al. | 473/613 |
| 5,284,341 | 2/1994 | Routzong et al. | 473/613 |
| 5,306,191 | 4/1994 | Phillips et al. | 473/613 |
| 5,779,576 | 7/1998 | Smith, III et al. | 473/613 |
| 5,807,198 | 9/1998 | Grimm | 473/613 |

*Primary Examiner*—Steven Wong
*Attorney, Agent, or Firm*—Warren F. B. Lindsley; Frank J. McGue

[57] ABSTRACT

This invention is directed to a toy football formed in the shape of a prolate spheroid having a tail extending out of one end thereof and having a plurality of fins extending laterally out of said tail for controlling the momentum of the football during flight.

12 Claims, 1 Drawing Sheet

TOY FOOTBALL WITH SPIRAL LIKE TAIL

BACKGROUND OF THE INVENTION

This invention relates to toy footballs and more particularly to football shaped objects having a finned tail that modifies the momentum of the ball after being thrown.

DESCRIPTION OF THE PRIOR ART

Toy footballs are known which employ a tail for guiding the ball during flight but none are known which add to the momentum of the football during flight.

It should be known that such controlled flights of the toy football are particularly desired during practicing of the forward pass.

SUMMARY OF THE INVENTION

In accordance with the invention claimed, a new and improved toy football is provided for use in practicing the forward pass and other pass configurations used in the game of football. This improved toy football is provided with a tail which effects the distance of flight and the momentum of the ball when thrown.

It is, therefore, one object of this invention to provide a new and improved toy football for use in practicing the forward pass.

Another object of this invention is to provide a tail for a prolate spheroid ball which affects the flight thereof.

A further object of this invention is to provide a tail like attachment for a toy football which adds to its distance of flight.

A still further object of this invention is to provide a spiral tailed football which affects its momentum during flight.

A still further object of this invention is to provide a toy football having a convoluted tail for aiding in its flight.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
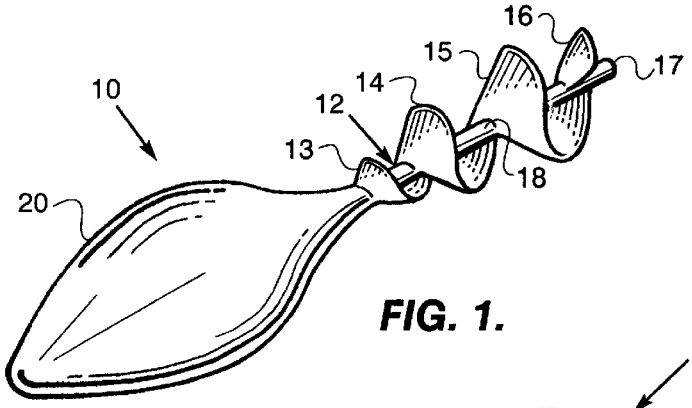
FIG. 1 is a front perspective view of a spiral tailed toy football and embodying the invention.

Referring more particularly to the drawing by characters of reference, FIG. 1 discloses a molded solid plastic filled toy football 10 formed in the shape of a prolate spheroid ball and having a tail 12 extending longitudinally thereof. Tail 12 is provided with convolutes or fins 13–16 along its length which when the football is in flight forces the air impacted by the ball sequentially on each of the fins 13–16 formed around the tail 12 downstream thereof to its end 17.

Figure 2:
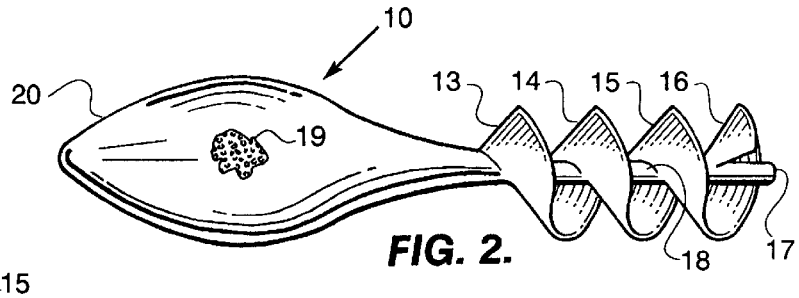
FIG. 2 is a modification of the toy football shown in FIG. 1 employing like size fins.

It should be noted that the convolutes or fins 13–16 in FIG. 2 are of the same geometrical configuration spaced equally along tail 12 of the football a like distance apart.

The toy footballs shown in FIGS. 1–5 are formed of a relatively resilient plastic foam-like material 19.

Figure 3:
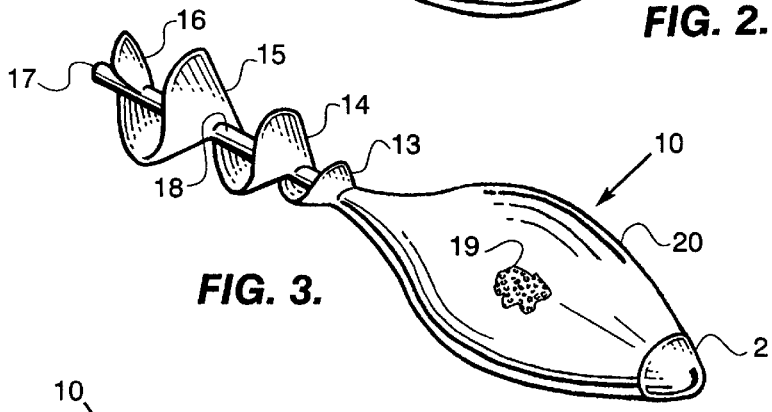
FIG. 3 is a perspective view of a modification of the spiral tailed football shown in FIG. 1 wherein the forward end of the toy football is weighted by a cone shaped member.

As shown in FIG. 1, the convolutes or fins 13–16 are of a different size while in FIG. 2 the fins all are of the same size spaced a like distance apart. In FIG. 3, football is provided with different size fins with the forward tip of the toy football covered by a nose shield 21 which may be formed of a plastic or metallic material suitably fixed to the tip of the toy football.

Figure 4:
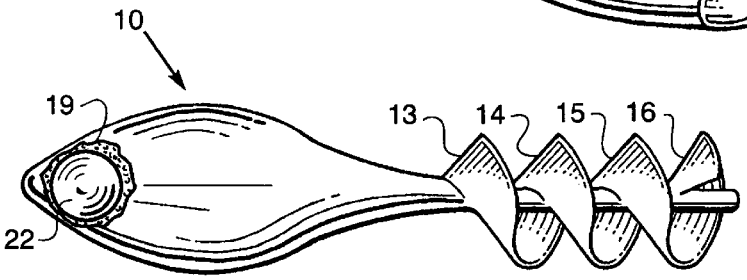
FIG. 4 is a still further modification of the spiral tailed toy football shown in FIGS. 1–3 wherein a ball is embodied in its forward end for weighting purposes.

As shown in FIG. 4, the toy football 10C is provided with a ball 22 formed in the nose of the toy for weighting purposes.

Figure 5:
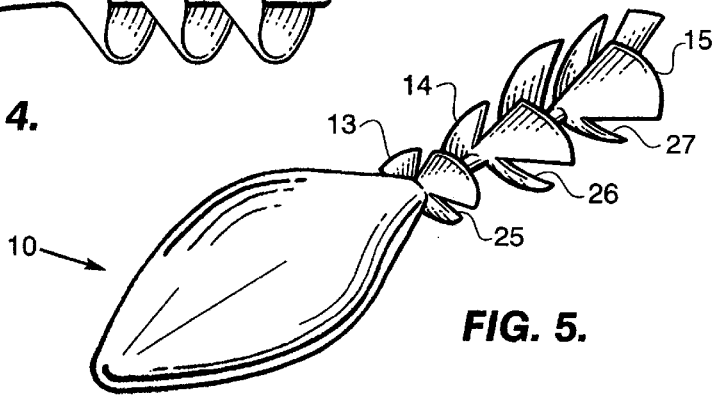
FIG. 5 is a further modification of the fin assembly shown in FIGS. 1–4 wherein notches are provided in the fins to cause the toy football to act as a spiral dart during fight.

FIG. 5 discloses a modification of the fin assembly of the toy football 10 shown in FIG. 1 wherein like parts are given the same reference characters. Fins 13–15 in FIG. 5 are modified to provide notches 25–27 therein for causing the toy football assembly to act as a spiral dart during flight.

It should be noted that the fins in FIGS. 1–5 are formed and operate in an auger like configuration.

Although but a few embodiments of the invention have been illustrated and described, it will be apparent to those skilled in the art that various changes and modifications may be made therein without departing from the spirit of the invention or from the scope of the appended claims.

What is claimed is:

1. A toy football having a prolate spheroid molded body:

a cylindrical shaped tail extending longitudinally out of said body a predetermined distance;

a plurality of fins formed on and along said tail, said fins being of a convolute, auger like configuration;

said fins being shaped to direct the air impacted by the toy football when in flight sequentially from one fin to another to affect the momentum of the flight of the toy football.

2. The toy football set forth in claim 1 wherein:

said body is formed of a resilient plastic material.

3. The toy football set forth in claim 1 wherein:

said fins are of a like configuration uniformly arranged along the length of said tail.

4. The toy football set forth in claim 1 wherein:

said fins are formed to extend along said tail and are equally spaced from each other.

5. The toy football set forth in claim 1 wherein:

the tip of said body is covered with a shield.

6. The toy football set forth in claim 1 wherein:

a ball is molded in the tip of said body for weighting purposes.

7. The toy football set forth in claim 1 wherein:

said tail comprises a resilient rod extending from within said body outwardly thereof along the longitudinal axis of said body.

8. A toy football comprising:

a prolate spheroid; and a tail section extending longitudinally out of said prolate spheroid body, said tail section is comprised of a fin shaped as a spiral helix having a convolute, auger like configuration.

9. A toy football as set forth in claim 8 wherein said fin formed in the shape of a spiral helix has an outer diameter that is constant along the longitudinal axis of said fin.

10. A toy football as set forth in claim 8 wherein said fin formed in the shape of a spiral helix has an outer diameter that varies along the longitudinal axis of said fin.

11. A toy football as set forth in claim 10 wherein said fin formed in the shape of a spiral helix has an outer diameter that is tapered along the longitudinal axis of said fin from an initial diameter at an end of said tail opposite where said tail attached to said prolate spheroid body to a more narrow diameter at an end where said tail attaches to said prolate spheroid body.

12. A toy football as set forth in claim 8 wherein said fin formed in the shape of a spiral helix has a plurality of notches in said fin thereby permitting air to flow longitudinally along said fin as well as in a spiral direction.

* * * * *